United States Patent [19]

Kolt

[11] Patent Number: 4,557,183

[45] Date of Patent: Dec. 10, 1985

[54] INCREMENTALLY ADJUSTABLE VENT

[75] Inventor: Stanley Kolt, Mamaroneck, N.Y.

[73] Assignee: Leonard W. Suroff, Jericho, N.Y. ; a part interest

[21] Appl. No.: 673,588

[22] Filed: Nov. 21, 1984

[51] Int. Cl.[4] ..... F16K 24/04

[52] U.S. Cl. ..... 98/42.16; 251/297; 251/303

[58] Field of Search ..... 98/42 R, 43 R, 43 C, 98/41 R, 116, 119; 126/288, 295; 251/111, 113, 297, 298, 299, 251, 303

[56] References Cited

U.S. PATENT DOCUMENTS

| | | | |
|---|---|---|---|
| 928,481 | 7/1909 | Tenold | 251/298 X |
| 1,351,109 | 8/1920 | Livengood | 251/297 X |
| 2,272,960 | 2/1942 | Young, Jr. | 251/297 X |
| 2,659,292 | 11/1953 | Kurek | 98/41 R X |
| 2,718,187 | 9/1955 | Frisby | 98/41 R X |
| 2,835,269 | 5/1958 | Seymour | 251/298 X |
| 4,295,486 | 10/1981 | McCabe | 251/251 X |

FOREIGN PATENT DOCUMENTS

| | | | |
|---|---|---|---|
| 623257 | 2/1963 | Belgium | 126/288 |
| 2652838 | 5/1978 | Fed. Rep. of Germany | 98/42 R |

*Primary Examiner*—Harold Joyce
*Attorney, Agent, or Firm*—Leonard W. Suroff

[57] ABSTRACT

An energy saving incrementally adjustable vent, for permitting the passage of air from one defined space to another which can be mounted on a vertical or horizontal surface includes a frame for mounting over an opening communicating therebetween. The frame has a central passageway disposed therethrough and a flap movably mounted to the frame, so as to be movable from a closed position substantially blocking the passageway, to an open position, permitting the flow of air therethrough. An adjustment device has a detent apparatus affixed to the frame. The adjustment device cooperates with the flap to provide a means for selectively adjusting the amount of air flow therethrough.

11 Claims, 5 Drawing Figures

FIG. 3
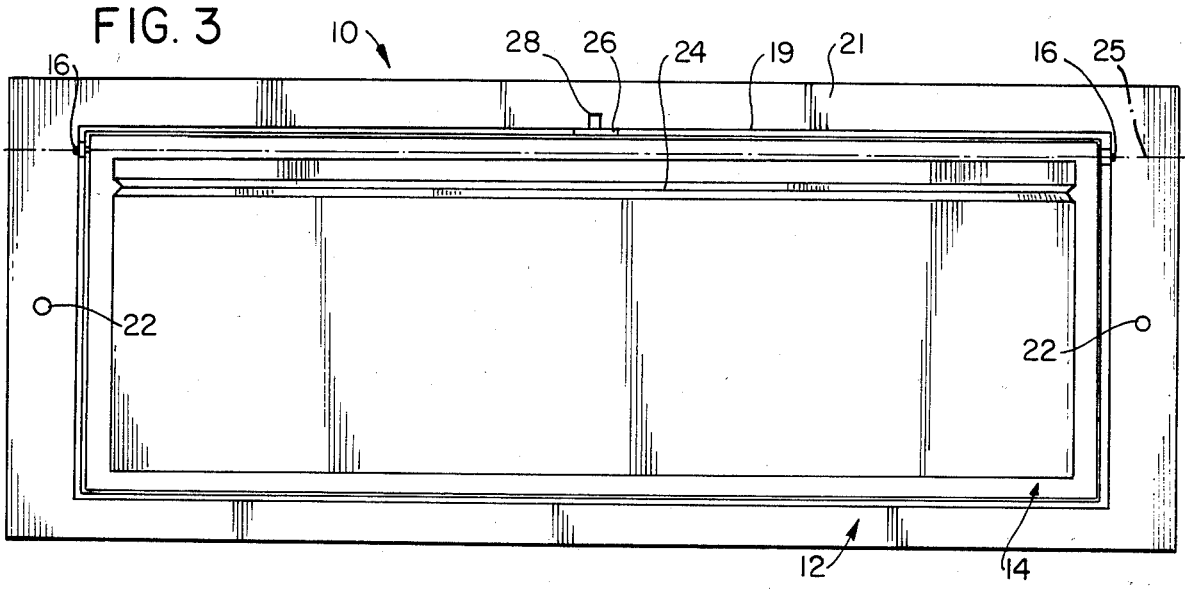
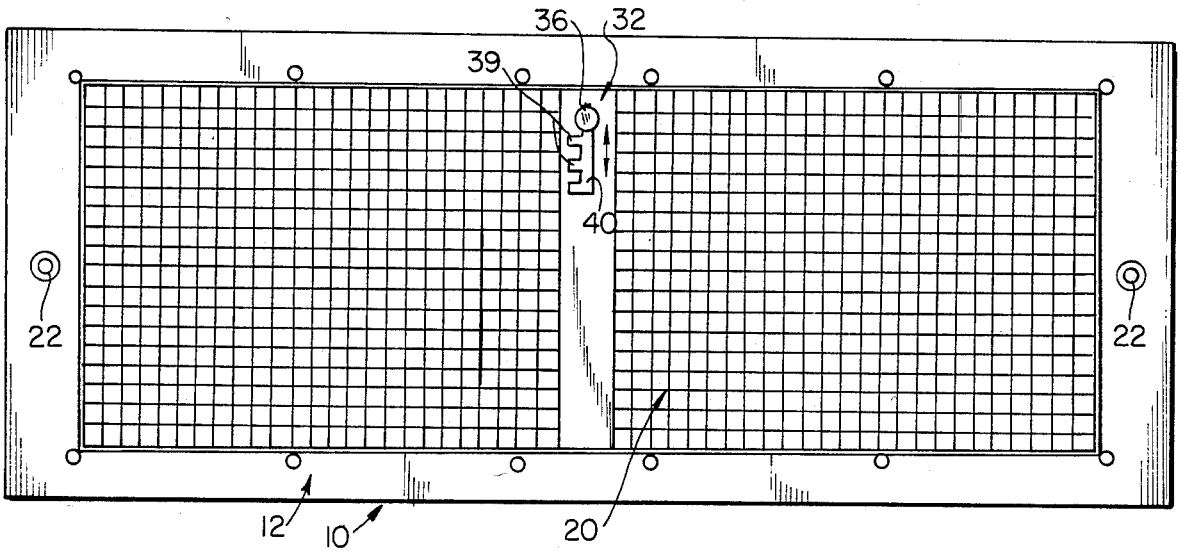
FIG. 4
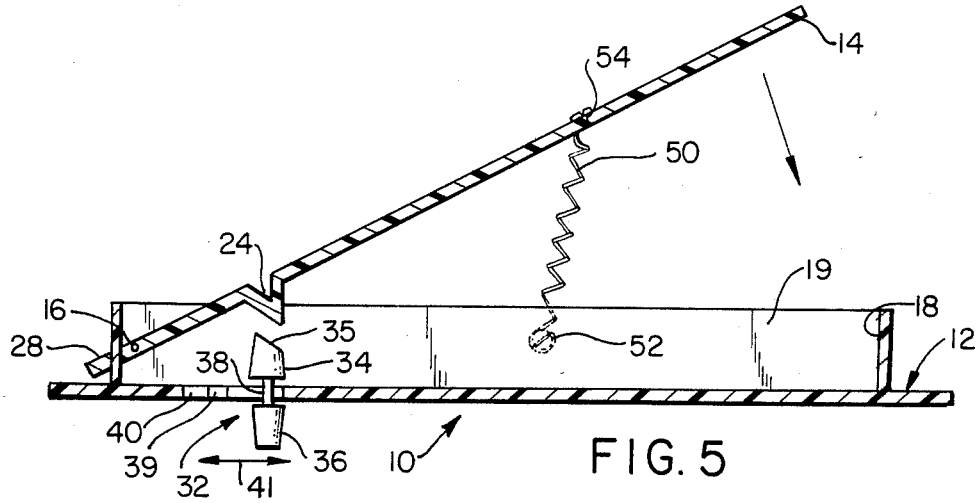
FIG. 5

INCREMENTALLY ADJUSTABLE VENT

BACKGROUND OF THE INVENTION

1. Field of the Invention

The present invention relates generally to vents for use in permitting the passage of air from one defined space to another such as, for example, through the ceiling of a room into an attic space or between rooms, and more particularly is directed to a vent that is incrementally adjustable to provide predetermined amounts of air flow therethrough.

2. Description of the Relevant Art

It is frequently desirable to permit the venting of air from a room space into an attic which is in itself vented to the outside atmosphere or to vent air from one room to another to remove unwanted odors or to equalize the temperature therebetween. As a result of such an arrangement, when the attic is vented through active or passive means, the rooms which employ vents can also be similarly vented. For example, cool air can be permitted to enter one room and then another with a room or rooms containing warmer air with contaminants, odoriferous aromas and moisture can be caused to be vented to an adjoining room and then through vents mounted on the ceiling into the attic space thereabove so that they can be vented into the attic space and then out of the building. Ventilators which are employed to vent from attic areas, or the like, through roofs to the atmosphere are known in the art. Such devices include those shown in U.S. Pat. Nos. 4,123,001 and 4,210,277 invented by the inventor of the subject invention. Additionally, an automatic ceiling ventilator is disclosed in U.S. patent application Ser. No. 505,789 filed June 20, 1983, also by the same inventor as the present invention.

Unfortunately, for various reasons, including their large size and complexity, none of the presently known vents are capable of providing an incrementally adjustable flow of air from one confined space to another. Furthermore these vents generally are unable to be mounted on a vertical wall surface while specifically permitting a predetermined selectable amount of air to flow between to confined air spaces. An inexpensive mechanical structure for providing the incremental amount of air flow is also desirable.

An additional disadvantage of known devices is that some are maintained in an entirely closed position until the temperature of the temperature responsive mechanisms associated therewith is reached. In certain instances the controlled air flow is permitted in only one direction. It may be desirable to permit air flow regardless of the temperature of the air proximate the venting device. An apparatus for providing preselected amount of air flow with relatively easy means for changing the amounts thereof has not been disclosed in the relevant art.

The present invention overcomes the shortcomings associated with the relevant art by providing preselected incremental amounts of air flow through a vent which may be mounted on a horizontally or vertically disposed surface, permitting the passage of air from one defined space to another.

OBJECTS OF THE INVENTION

An object of the present invention is to provide an adjustable vent for use in ventilating systems wherein one room may be vented into another room and is also suitable for venting into attics or other similarly defined spaces.

Another object of the present invention is to provide a vent which requires no maintenance and may be selectively changed to increase or decrease the air flow therethrough.

A further object of the present invention is to provide a vent which may be mounted in a wall or a ceiling.

A yet further object of the present invention is to provide a ceiling vent which may be used in conjunction with attic-type ventilators to provide an integrated house ventilation system.

SUMMARY OF THE INVENTION

An energy saving incrementally adjustable vent for permitting the passage of air from one defined space to another suitable for installation in walls or ceilings of rooms of a house wherein the rooms may be vented between each other and into an attic area which is itself vented to the outside atmosphere. The damper or flap of the vent may be biased to a closed or partially open position by selection of one of the detent positions provided.

An adjustable vent, according to the principles of the instant invention, includes; a frame which is configured for mounting over an opening communicating between one defined space to another defined space, such as a wall or an opening provided in the ceiling of a room, the frame having a central passageway disposed therethrough. A flap is movably mounted to the frame, preferably by a suitable pivot arrangement, such that the flap is movable from a closed position, substantially blocking the passageway in the frame, to an open position permitting the free flow of air therethrough, the flap may be biased to the closed position when at rest by a spring or may open a preselected amount. An adjustment device in the form of a movable knob and detent device which acts upon a wedge provided on the flap is provided to set the flap to a predetermined open position, if desired, in any mounting position thereby providing some degree of ventilation at all times.

The foregoing and other objects and advantages will appear from the description to follow. In the description reference is made to the accompanying drawing which forms a part hereof, and in which is shown by way of illustration, specific embodiments in which the invention may be practiced. These embodiments will be described in sufficient detail to enable those skilled in the art to practice the invention, and it is to be understood that other embodiments may be utilized and that structural changes may be made without departing form the spirit and scope of the invention. The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawing in which:

FIG. 3 is a top plan view of the vent of FIG. 2;

FIG. 4 is a slightly enlarged bottom plan view of the vent shown in FIG. 3 showing the adjustment device and detent apparatus; and FIG. 5 is a cross-sectional view taken substantially along the lines 5—5 of FIG. 2.

DESCRIPTION OF THE PREFERRED EMBODIMENT

Figure 1:
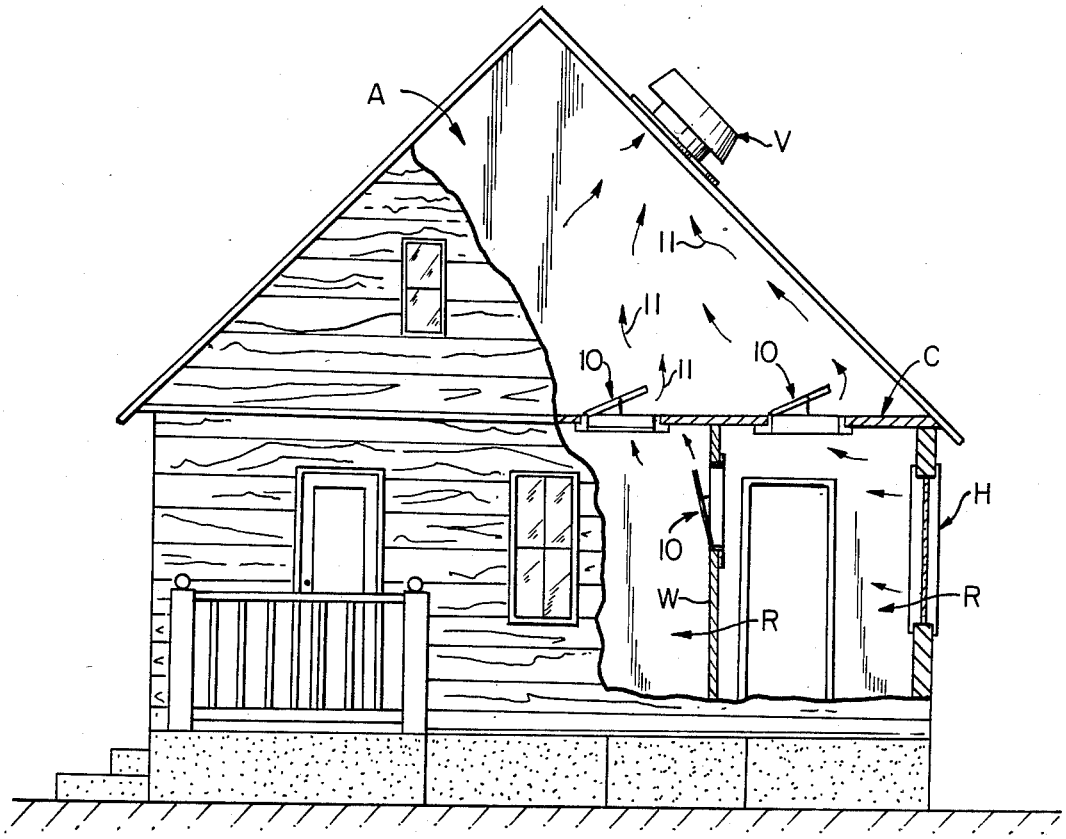
FIG. 1 is a partially broken away side elevational view of a house in which a plurality of incrementally adjustable vents and an attic vent are installed.

Referring now to the figures and more particularly, to FIG. 1, there is illustrated a house H having an attic A and rooms R adjacent to the attic A with a wall W separating two rooms. An automatic roof ventilator V is installed in the roof of the house H and vents the attic A to the outside atmosphere. A pair of vents 10 are installed in the ceiling C of the house H above the room R and serve to vent the room R into the attic A. A vent 10 is also mounted in the wall W forming the rooms to permit the free flow of air therebetween. The construction of the vents 10 will be hereinafter described in conjunction with FIGS. 2 through 5.

The vents 10 are each constructed so that they open and permit the flow of fresh air as is illustrated by the arrows 11 in FIG. 1, to enter the rooms R and the stale air to be exhausted into the attic A where it is then vented to the outside atmosphere through the vent V. Additional vents may be mounted in dividing wall W to permit air flow between rooms which do not have access to the attic. Depending on the mechanical adjustment see (FIG. 5) of the vents 10, they can be entirely closed or can be opened a desired degree to permit ventilation. In a typical installation, one adjustable vent 10 is placed in the ceiling of each room adjacent to the attic so that each room has an equal opportunity to have the contaminated and/or undesirable air vent therefrom through the attic to the outside atmosphere with additional vents provided in the walls of selected rooms to provide a continuous air flow through all the rooms.

Figure 2:
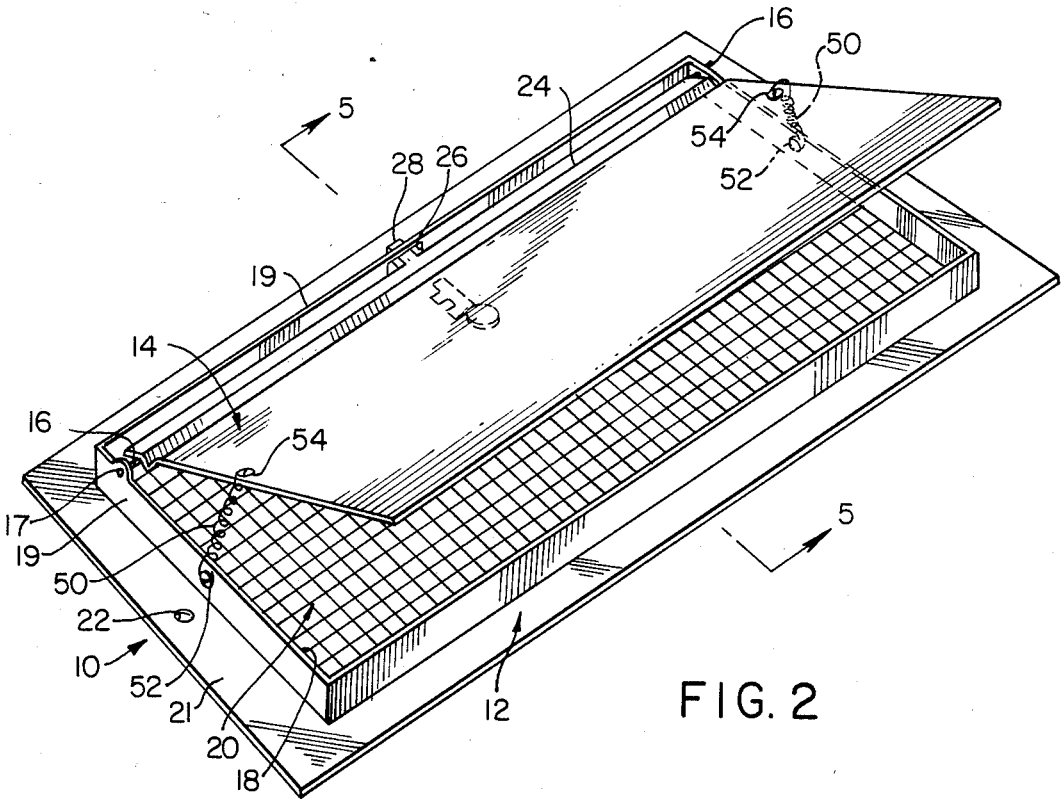
FIG. 2 is a top view in perspective of an incrementally adjustable ceiling vent, incorporating the principles of the present invention.

Referring now to FIGS. 2 through 4, the vent 10 is seen to include a frame 12 and a flap 14. The flap 14 is pivotally affixed to the frame 12 by a pair of protrusions 16 that are integrally formed with the flap 14 and which journal in apertures 17 provided on a lip portion 19 provided on the frame 12, in a conventional manner. The frame 12 has a central passageway 18 disposed therethrough, which may be selectively blocked by the flap 14 depending upon its position relative to the frame 12 as it pivots on the protrusions 16. The frame 12 has the central passageway 18 thereof covered by a grille 20 which preferably is an integral part thereof, as shown in FIG. 4, and is similar to that of conventional vents or registers. Of course, although the grille 20 is shown as having a particular pattern and configuration, it is to be understood that those of ordinary skill in the art can modify this configuration as desired.

In order to reduce the costs of manufacture, the frame 12 and flap 14 are preferably constructed of a plastic material well-suited for such an application. The pivot protrusions 16 provided on the flap 14, may take the form of integrally-formed protrusions, which are molded with the flap 14 as shown, or may be formed by a rod, not shown, disposed on the pivotal axis 25 that extends longitudinally along the flap 14. The edges 21 of the flap 14 include a plurality of mounting apertures 22 for securing the frame 12 to a supporting surface such as wall W or ceiling C of FIG. 1. When mounted, as shown in FIGS. 2 and 4, the grille 20, on the underside of the vent 10 is exposed. The unexposed surface of the vent 10 is shown in FIG. 3 with the flap 14 in a closed position.

The flap 14 has a centrally disposed longitudinal depression 24 disposed therein proximate the pivot axis 25 (broken line) whose function will be described hereinafter. Proximate the wedge-shaped depression 24 is an elongated aperture 26 which extends through the lip portion 19 of frame 12. The aperture 26 is dimensioned to accommodate therethrough and cooperate with a stiffening protrusion 28 provided on the flap 14.

With specific reference to FIGS. 4 and 5, the manner in which the wedge-shaped depression 24 extends can readily be viewed with the flap 14 being illustrated in an open position (FIG. 5). The flap 14 is preferably molded with the substantially V-shaped ridge (wedge-shaped depression) 24 together with the protrusions 16 and 28. The ridge (depression) 24 is adapted to cooperate with an adjustment slide 32. The adjustment slide 32 comprises an inner button 34 which may be provided with an inclined surface 35 and an outer button 36 joined by a shaft 38. The shaft 38 is freely-slidably in a slot or aperture 40 disposed in the grille 20 of the frame 12, as shown in FIG. 5. The slot 40 provided in the grille 20, adjacent to the button 34 about the aperture 40, is preferably provided with detent slots 39 which are generally parallel to pivot axis 25 and/or transverse to slot 40 and when shaft 38 is inserted therein precludes sliding of the button without user intervention. The substantially V-shaped ridge 24 acts as an incline against which the inclined surface 35 of the button 34 interacts and depending upon the placement of the shaft 38 within the slot 40 and detent 39, the degree that the flap is permitted to close can be varied. As illustrated in FIGS. 4 and 5, when the adjustment slide 32 is at the right hand side of the slot 40, (FIG. 5); lower detent slot 39 (FIG. 4) the flap 40 is kept in an open position. As the adjustment slide 32 is moved in the slot 40 toward the left side of the drawing (FIG. 5), and the upper part of the drawing (FIG. 4), the amount the flap is kept open decreases until the incline of the substantially V-shaped ridge 30 is no longer contacted and the flap 14 can entirely close the central passageway 18 of the frame 12.

The interaction of the adjustment slide 32 and the substantially V-shaped ridge 30 provides an inexpensive yet effective means of adjusting the degree to which the flap 14 will close. Of course, other suitable means for adjusting the degree of closure of the flap 14 can be employed within the spirit and scope of the invention. Depending upon the particular plastic used to mold the flap 14, flexure thereof may occur where the substantially V-shaped ridge 30 is forced, against the adjustment slide 32. To preclude this, the protrusion 28, as illustrated in FIGS. 2 through 5 has been provided.

The flap 14 may be moved from its rest position, caused by gravity, to an open position as illustrated in FIG. 1. If the vent 10 is mounted vertically, such as in wall W with the opening of flap 14 extending upwardly, the depression 24 of flap 14 then may be urged into contact with button 34 with the aid of springs 50 which have one end thereof retained within apertures 52 provided in lip portion 19 of frame 12 and the other end thereof retained within apertures 54 provided in flap 14.

Although the ceiling vent 10 has been discussed as being formed from plastic, it is to be understood that it may be made from other materials including metal or the like. In addition, configurations other than the rectangular configuration illustrated can be manufactured and square, oval, or round vents are also possible.

Hereinbefore has been disclosed an inexpensive, reliable, incrementally adjustable vent capable of horizontal or vertical mounting which may be preset to provide a predetermined amount of air flow therethrough.

Although illustrative embodiments of the invention have been described in detail herein with reference to the accompanying drawings, it is to be understood that the invention is not limited to these precise embodiments, and that various changes and modifications may be effected therein without departing from the principles, scope or spirit of the invention.

Having thus set forth the nature of the invention, what is claimed is:

1. An incrementally adjustable vent for permitting the passage of air from one defined space to another space comprising:

(a) frame means for mounting over an opening communicating between said spaces having a passageway disposed therethrough, said frame means including;

(i) movable adjustment means for adusting the amount of opening of said passageway, and (ii) detent means for incrementally determining the amount of said opening; and (b) flap means movably mounted to said frame, said flap means being movable from a closed position substantially blocking said passageway to an open position permitting the free flow of air therethrough, including;

(i) a pivotal axis disposed proximate one edge of said flap means, and (ii) means positioned proximate said pivotal axis for cooperating with said adjustment means to move said flap means in a direction to open said passageway thereby increasing the amount of air flow therethrough.

2. An incrementally adjustable vent according to claim 1 wherein said pivotal axis includes a pair of protrusions provided on said flap means cooperating with mating apertures provided on said frame means.

3. An incrementally adjustable vent according to claim 1 wherein said pivotal axis includes rod means disposed on said flap means for cooperating with mating apertures provided on said frame means.

4. An incrementally adjustable vent according to claim 1 wherein said movable adjustable means includes a member means extending through said frame means, said member means being urged against said flap means in a direction to move said flap means towards said open position.

5. An incrementally adjustable vent according to claim 4, wherein said adjustment means further includes:

(a) a button member in contact with said flap means;

(b) rod means having one end thereof affixed to said button member and extending through said frame means; and (c) knob means affixed on the other end of said rod means for moving said adjustable means from one position to another.

6. An incrementally adjustable vent according to claim 5, wherein said detent means includes a slot provided in said frame means adapted to receive said rod means therein, said slot being provided with discrete transverse openings adapted to receive and retain said rod means therein until urged into another position.

7. An incrementally adjustable vent according to claim 5, wherein the upper surface of said button member is provided with an inclined plane adapted to cooperate with said cooperating flap means.

8. An incrementally adjustable vent according to claim 5, wherein said cooperating flap means includes an inclined plane.

9. An incrementally adjustable vent according to claim 1, further including bias means for urging said flap means against said movable adjustment means.

10. An incrementally adjustable vent according to claim 9, wherein said bias means is a coil spring operatively coupled between said flap means and said frame means.

11. An incrementally adjustable vent according to claim 1, wherein said passageway includes a grille.

* * * * *